United States Patent [19]

Benoit

[11] Patent Number: 4,883,450

[45] Date of Patent: Nov. 28, 1989

[54] PROCESS FOR MAKING SINGLE SIDE FREE PLASTIC BAG

[75] Inventor: Gordon L. Benoit, Macedon, N.Y.

[73] Assignee: Mobil Oil Corp., New York, N.Y.

[21] Appl. No.: 115,318

[22] Filed: Nov. 2, 1987

[51] Int. Cl.[4] ..... B31B 1/64

[52] U.S. Cl. ..... 493/196; 493/204; 493/926; 383/9

[58] Field of Search ..... 493/196, 204, 926; 206/610; 383/8, 9, 10, 37

[56] References Cited

U.S. PATENT DOCUMENTS

| | | | |
|---|---|---|---|
| 4,464,157 | 8/1984 | Benoit | 493/211 |
| 4,476,979 | 10/1984 | Reimann | 206/554 |
| 4,493,419 | 1/1985 | Prader | 206/554 |
| 4,554,192 | 11/1985 | Benoit | 428/35 |
| 4,588,392 | 5/1986 | Maddock | 493/200 |
| 4,597,749 | 7/1986 | O'Brien | 493/226 |
| 4,604,084 | 8/1986 | Pistner | 493/226 |
| 4,744,200 | 5/1988 | Benoit, Jr. et al. | 493/204 X |

*Primary Examiner*—Eugene R. Laroche

*Assistant Examiner*—Robert J. Pascal

*Attorney, Agent, or Firm*—Alexander J. McKillop; Charles J. Speciale

[57] ABSTRACT

The present invention is a method of continuously making thermoplastic film bags having one-side-free for separation from an opposite side. The method includes providing a continuous tube of thermoplastic film for formation of the bag, such tube having a continuous surface which forms opposing sides of the bags. The tube is directed to a bag forming means which continuously flattens the tube into at least the opposing sides of the bag. The tube must intermittently be partially severed on one of the opposing sides at intervals corresponding to single bag lengths, such severance being made at a location for providing detachable separation of the one wall from the opposing wall. Next a sealed seam is formed across the tube at intervals which provide bottoms to each of the bags, and the bags are then collected in a stack where they are substantially aligned followed by fusing the stack of substantially aligned bags adjacent the severance in the one side for separating the bags from stack one side at a time.

9 Claims, 4 Drawing Sheets

PROCESS FOR MAKING SINGLE SIDE FREE PLASTIC BAG

BACKGROUND OF THE INVENTION

The present invention relates to thermoplastic bags useful for packing groceries, and, in particular, to a method of providing a convenient structure for opening such bags, one bag at a time, from a bag pack which includes a supply of bags hung together at a bag dispensing station.

In the past, it has been known to manufacture bags having different configurations in order to provide convenient means of packaging for various uses. For example, it has been known to provide a thermoplastic bag with loop handles which are integral with the bag and can be easily formed by cutting a T-shirt-like formation in a stack of bags. The integral handle can be reinforced by providing a double overlap on either edge of a thermoplastic tube such as by gussetting the tube over folding elements provided in the manufacturing line.

For example, U.S. Pat. No. 4,597,749 to O'Brien, et al. discloses a thermoplastic bag characterized by having a pair of carrying handles formed integrally with the bag walls and extending upwardly from the opposite sides of an open mouth portion of the bag. The handle members are reinforced and comprise at least two layers of thermoplastic material, one of the layers forming the bag, body and handles and the other layer serving as a reinforcement layer, the reinforcement layers being provided only in the handle areas of the bag structure.

In U.S. Pat. No. 4,588,392 to Maddock a plastic film sack having gussetted sidewalls is disclosed wherein a heat-seal stripe welding is provided in the bottom of the sack to gather four film layers in the gussetted regions of the sack while a heat-seal stripe welding gathers the two film layers between the gussetted regions. Between the heat seal stripes of the four film layers and the heat-seal stripe of the two film layers are unsealed arcuate stress relief regions.

In U.S. Pat. No. 4,554,192 to Benoit a bag structure for thermoplastic material is disclosed wherein there are front and rear bag walls connected by sidewalls which has an open mouth top portion. The open mouth portion is characterized by having handles located at opposite end regions, such handles having two films as a result of being integral extensions of the front and rear gussetted sidewalls. The bag also has a bottom wall planarly extensible so as to form a rectangle with at least no substantial excess film outside of the bulk volumetric capacity of the bottom region of the bag.

In U.S. Pat. No. 4,493,419 to Prader, et al. a bag pack of a plurality of stacked thermoplastic bag structures is disclosed wherein each bag has a front and rear bag wall and an open mouth top portion. Handles are integral extensions of the bag walls. The bags are bonded together via bonding means in association with the handles. Individual bags may have stress release curves in the handles and the bag mouth opening.

U.S. Pat. No. 4,476,979 to Reimann, et al. discloses a bag pack and individual bags characterized by having handles which are integral extensions of the front and rear of the bags. The bags have a bag mouth which includes stress release curves on both sides of an upwardly extending tab. The tab includes at least one opening which is positioned to create comparatively narrow webs which serve to be tear-off points severing individual bags from the pack. The bags are bonded together via the tab at areas adjacent the openings.

See also U.S. Pat. No. 4,464,157 to Benoit, et al. which relates to thermoplastic bag structures characterized by having a pair of carrying handles formed integrally in the bag walls and extending upwardly from opposite sides of the open mouth portion of the bag. The handle bags are particularly characterized in having reinforced handle members having two layers of thermoplastic material, one of the layers imparting tensile strength to the individual layer and the other layer particularly employed to provide requisite puncture and tear resistance necessary in such a bag structure.

In U.S. Pat. No. 4,604,084 to Pistner a thermoplastic bag structure is disclosed which has a front and rear bag wall, a bottom and an open mouth top portion, the open mouth portion having two pairs of single film handle loops each of which are located at opposite ends of the open mouth portion. The bag structures are unitized by providing a detachable tab at the mouth opening and unitizing the bag structures through this tab. The method of forming the bags involves providing an end seal collapsed thermoplastic film tube and removing plastic to form a bag mouth opening and handles at one end thereof. The resulting bag is an ungussetted bag which can be unitized into a pack by providing a detachable, unitizing tab at the bag mouth opening.

In some of the most recent developments in the area of providing thermoplastic bags at grocery counters, it is necessary to provide an opening through the pack of bags for mounting on a tab which is located on a rack generally located at the end of the grocery counter. The bags such as those shown in the Reimann, et al. '979 patent must then be unthreaded one side at a time over the mounting tab and expanded over arms in order to form a wide mouth opening for packing the plastic bags. This method generally suffers from the drawback that the front and back sides of each of the bags are bonded or welded together such as by means of heat sealing or otherwise. In the Reimann, et al. '979 patent, the bags are bonded together on a tab adjacent the opening. This feature reduces the ability of the packer to separate the sides of the bag to form the open mouth receptacle.

Thus, it is a primary object of the present invention to provide a method for forming a thermoplastic bag having an easily separable bag mouth opening by providing one side of the bag relatively free for opening from the other side of the bag.

SUMMARY OF THE INVENTION

The present invention is a method of continuously making thermoplastic film bags having one side free for separation from an opposite side which includes providing a continuous tube of thermoplastic film for formation of the bags, such tube having a continuous surface which forms opposing sides of the bag. The tube is directed to a bag-forming means which continuously flattens the tube into at least two opposing sides of such bags. The tube is intermittently at least partially severed at one of the opposing walls at intervals corresponding to single bag lengths such that the severance is at a location for providing detachable separation of one sidewall from the opposing sidewall. The tube is then subjected to heat sealing thereacross so that seams can be formed at intervals in order to provide bottoms to the bags. The separated bags are then collected in a stack wherein the bags are substantially aligned so that the stack can be fused together adjacent the point of severance in the one side of each bag to facilitate separating one side from the other in the stack.

Preferably the method can also include forming the thermoplastic film into a gussetted tube before or simultaneously while directing the tube to the bag forming means. Moreover, two pairs of diagonal seams can be formed over the portions of the tube corresponding to the gussets along lines diagonal to the length of the tube, the pairs of opposite sides being at an angle to one another, and removing the double film triangular regions bounded by the diagonal seams so that a flat bottom gussetted bag can be formed.

Furthermore, the present method preferably includes forming a handle and bag mouth opening at the opposite end of the sack bottom by imposing a compound curve cutting knife on the assembled stack of bags.

As a result of the present invention, a stack of bags can be provided for use in a bag packaging rack or assembly wherein the bags can be threaded over a tab on a bag rack or assembly and individual bags can be opened therefrom by separating them one side at a time away from the stack of bags.

For a better understanding of the present invention, together with other and further objects, reference is made to the following description, taken in conjunction with the accompanying drawings, and its scope will be pointed out in the appended claims.

DETAILED DESCRIPTION OF THE INVENTION

Figure 1:
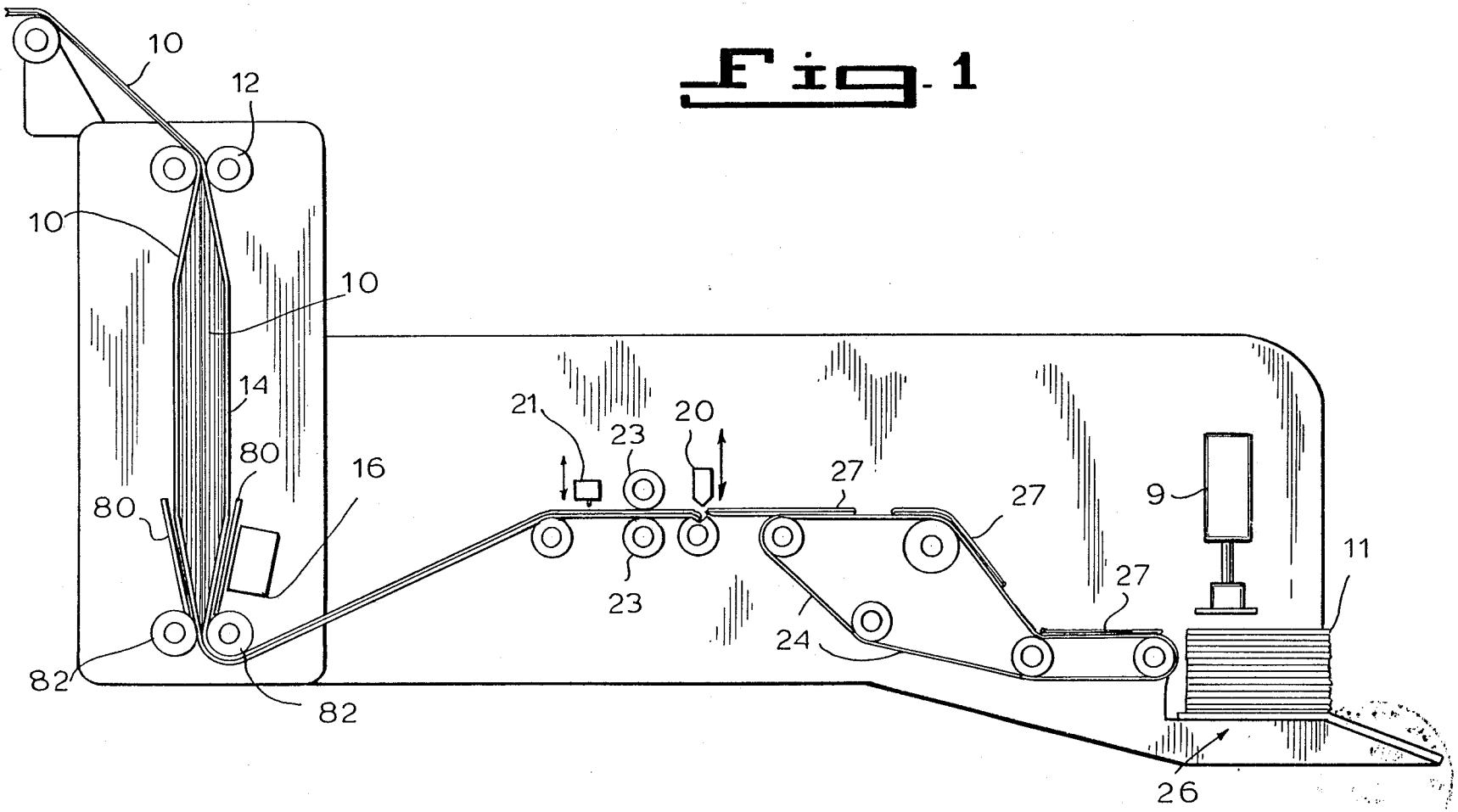
FIG. 1 is a schematic of the process of the present invention.

Referring to FIG. 1 there can be seen a process line in accordance with the present invention wherein a tube of thermoplastic film 10 can be provided to a bag fabrication line via guide rollers 12. The tube of film 10 can be separated by, for example, a stream of air introduced to the interior of bag (not shown herein) such that at least one wall 14 thereof is exposed to a cutting assembly 16. The cutting assembly 16 can include various cutting means such as a series of blades to form perforations, or single blades which can be used to slice through the one side 14 of the tube of film 10. As the tube of thermoplastic film is drawn past the cutting assembly 16, the cutting means is caused to intermittently cut into the tube either by a reciprocating force imposed thereon or by means of a intermittent slashing action whereby the blade is drawn across a portion of the wall 14 of film 10.

Figure 2:
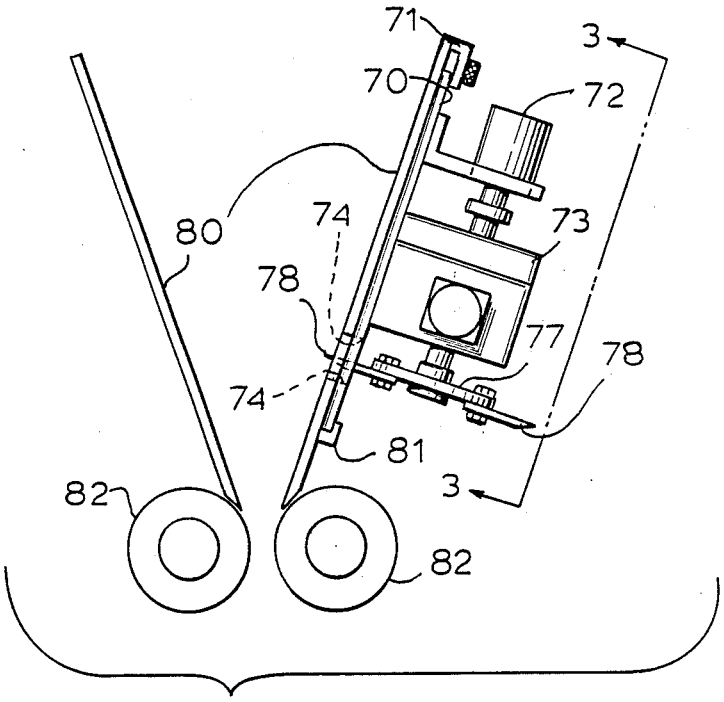
FIG. 2 is a side elevation schematic view of a cutting assembly in accordance with the present invention.
Figure 3:
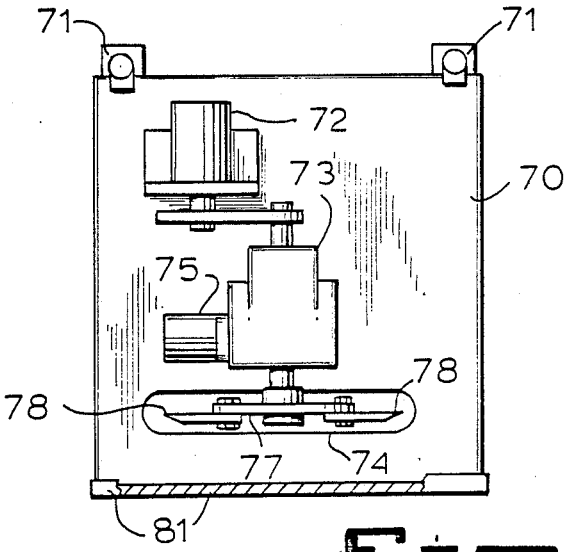
FIG. 3 is a plan view of the cutter assembly shown in FIG. 2 taken along lines 3—3.

Referring to FIG. 2 and FIG. 3 one preferred cutting assembly is depicted which includes a mounting plate 70 mounted on a gusset box 80 wherein a tube of film can be guided, side gussetted, and drawn through to downstream operation by means of rollers 82. A gusset box can simply be provided by use of sheet metal being inwardly oriented at either side of the bag flattening rolls 82. Alternatively, the film need not be side gussetted thus eliminating the requirement for the gusset box 80. In this latter case, it is only necessary to orient the tube of film such that one side wall is adjacent the cutting assembly. With respect to the assembly shown herein, the mounting plate 70 can be removable so that affixing the plate to the gusset box can be effected by a bracket 81 and holddown clamps 71.

A motor 72 is secured to the mounting plate, and is connected for actuating a rotatable double blade holder 77 through a clutch assembly 73 which includes solenoid 75. The blade holder 77 can, in turn, be provided with two blades 78 which, in a preferred embodiment, can be heated for ease of cutting through thermoplastic film. In the present preferred embodiment blades 78 pass through an opening 74 in the mounting plate 70 to engage and slice the film surface 14.

The cutting action of the cutting assembly 16 is imposed on the wall 14 intermittently so that the length of thermoplastic tube located between cuts is the length of one bag. Furthermore, the location of the cut on the tube 10 is such that it will be located proximal the bag bonding point and the bag opening which is to be used for mounting on a bag rack system.

In order to effect the proper cutting or slashing action, the motor 72 can be rotating at a high RPM so that when an actuating signal is received from, for example, a printing station located upstream which has been indexed to print at one-bag intervals, the solenoid 75 is fired and the clutch 73 makes a 180° revolution at high speed. Since the blade holder 77 is fixedly attached to the clutch 73 it is also rotated at high speed causing a blade to pass through the slot 74 and a slot in the wall of the gusset box in a slashing action to cut the tube of film 10 at the desired location. The width of the cut is determined by the length of the blade and blade holder assembly. One unique advantage of the invention in accordance with this embodiment is that the opening can be made in one side 14 of the film tube 10 without the use of a "mouse" or other fixed device in the inflated bubble. When the blade 78 is heated penetration without need for a back-up plate is enhanced.

Figure 4:
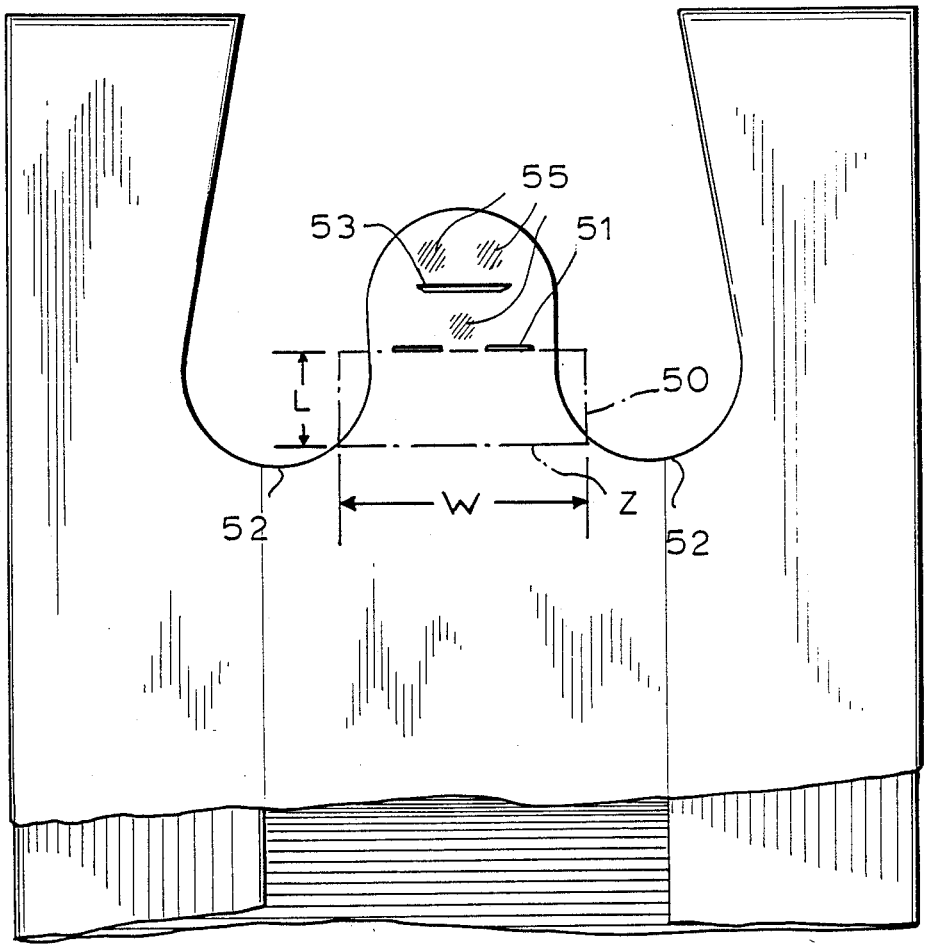
FIG. 4 is a schematic of the cut-out portion of a double layer loop handle bags which shows the relationship of the spacing and arrangement of bag cuts made in accordance with the present invention.

Referring to FIG. 4, there is shown the "window" 50 wherein each bag must cut. Basically, the dimensions of the window are determined by the length of the neck "L" between the perforations 51 and the line "Z" adjoining the top of stress relief curves 52. The dimension "W" of this line determines the maximum width of the cut. The neck or tab also includes the hang hole 53 which passes through all the layers of all the bags whereby a supporting projection on a bag rack can be passed therethrough for hanging the stack of bags. Furthermore the stack of bags can be welded together such as at weld spots 55 to facilitate handling of the bags. When the bag is to be partially supported by the perforated attachment at the rear of the bags during loading procedures, the perforations should be such as to provide a strong connection, e.g., there should be sufficient plastic to support the bag.

Tube 10 is then flattened so that the wall 14 is directly opposed to a second wall which will form two sides of the thermoplastic bag. The stream of continuous thermoplastic bag material having the timed cuts imposed thereon is then directed to a subsequent processing step including a heating element 20, which can be impressed on the bag tube to simultaneously heat-seal and sever the bag from the continuous tube, and remove unwanted bag-wall-separating air by means of air removal punch 21 and press roll 23. At this stage of the process each thermoplastic bag has been formed having a sealed bottom, open or closed top and a suitably placed cut or perforation for providing a front side free thermoplastic bag for use in a bag dispensing rack or system.

Figure 7:
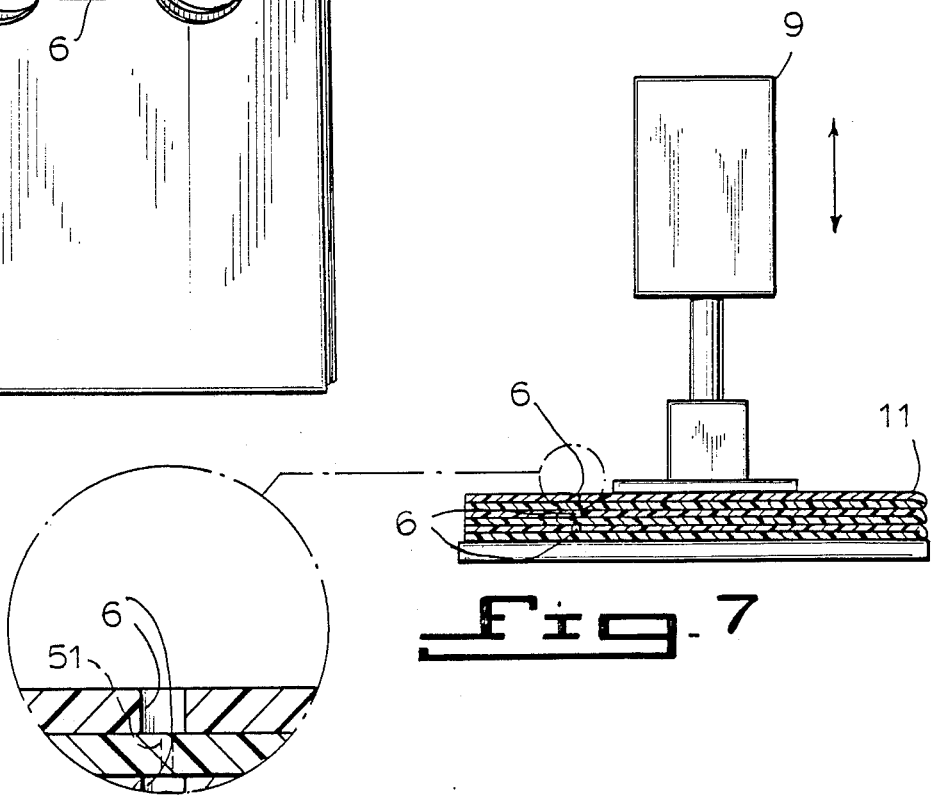
FIG. 7 is a side elevation schematic view of a cutting and welding station used in conjunction with the present invention.

The stream of bags 27 formed by the heating and sealing means 20 can then be fed along feed roll conveyor 24 to a station at which the bags can be stacked for cutting and other processing steps. This station is indicated generally at 26 in FIG. 1. The stack of bags 11 are shown at station 26 underneath a cutting and welding mechanism 9 located immediately thereabove. This station is shown in greater detail in FIG. 7. The stack of bags shown in FIG. 7 are shown in cross-section so that the individual cuts or perforations 6 of each bag can be more clearly seen.

The cutting and bonding device 9 can include a compound curve cutting blade in combination with straight blades and a spot welding device to cut the T-shirt configuration out of the tops of the bags, and to provide the hang holes at the top of the tabs. The spot welder heat welds the bags together to provide the unitary stack of bag for use at the end of grocery check out lines.

Figure 5:
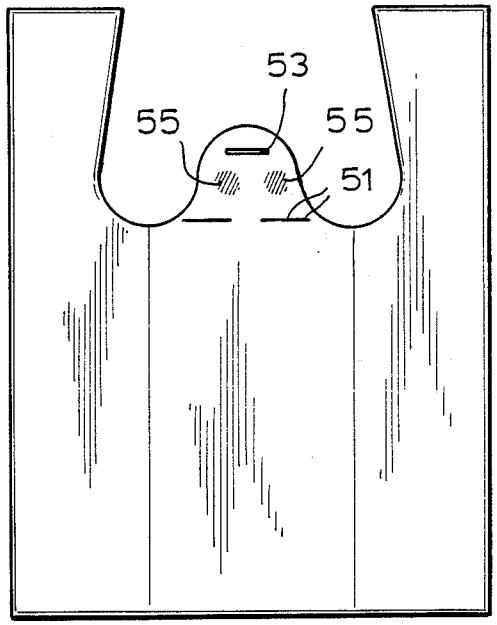
Fig. 5 (PRIOR ART)
FIG. 5 depicts a typical plastic bag with double layer loop handles which is not front side free.
Figure 6:
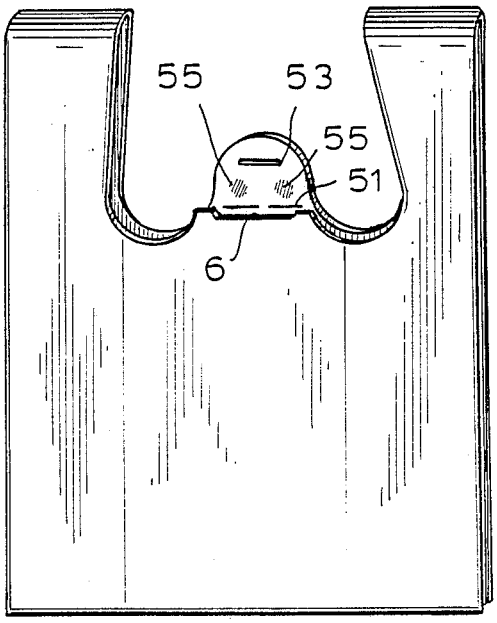
FIG. 6 shows a similar plastic bag prepared in accordance with invention which is front side free.

A comparison of the structure and operation of plastic bags having the T-shirt configuration at the top is depicted in FIGS. 5 and 6. FIG. 5 shows a plastic bag without the front side free and FIG. 6 shows a plastic bag prepared in accordance with the present invention wherein the front side is free to be separated from the back of the bag. In both Figures like features bear the same number. Thus, both bags are shown with a hang hole 53 and with weld spots 55 by which the stack is held together. Similarly, the bag shown in both Figures includes perforations 51 provided below the hang hole 53 and weld spots 55. However, perforations 51 in FIG. 5 are provided in both front and back layers, whereas perforations 51 in FIG. 6 are provided on the back wall only. The front wall of the bag shown in FIG. 6 has been cut in accordance with the process of the present invention so that the front side is free to be easily separated from the back wall by simply wiping a finger in the center of the bag whereby it is opened as shown in FIG. 6.

As mentioned previously, the front side free structure can be provided as a straight cut or as perforations. When the free front side is provided as perforations, the cuts are usually great in comparison to the remaining bag web since it is desirable to break the bag away from the tab with very little force, e.g., the force of a finger wiping against the front surface of the bag front side. Moreover, the cutting required to provide the free front side can be by either reciprocating or slashing action and can include one or several blades.

Thus, while there have been described what are presently believed to be the preferred embodiments of the present invention, those skilled in the art will realize that other and further changes and modifications can be made without departing from the true spirit of the invention, and it is intended to include all such changes and modifications as come within the scope of the claims.

I claim:

1. A method of continually making thermoplastic film bags having one side substantially free for separation from an opposite side; comprising:

providing a continuous tube of thermoplastic film for formation of said bags, said tube having a continuous wall which forms opposing front and rear sides;

separating said front and rear sides of said continuous wall from each other;

intermittently at least partially cutting one of said opposing sides of said continuous wall of said continuous tube at intervals corresponding to single bag lengths, thereby providing cuts therein at said intervals;

forming sealed seams across said continuous tube at intervals which provide sealed bottom ends for said bags; and severing said continuous tube at intervals to separate individual bags from said continuous tube such that each of said separated individual bags includes front and rear sides formed from said front and rear sides of said continuous wall of said continuous tube, top and bottom ends, and a cut within one of said front and rear sides thereof.

2. A method as defined in claim 1 including the step of forming a handle and bag mouth opening at said top end of each of said individual bags such that said cut intersects said bag mouth opening at two points.

3. A method as defied in claim 2 including the step of forming said bag mouth opening such that said top end of each of said individual bags includes a pair of opposing handles and a tab extending towards said top end of said individual bag, said cut extending across said tab.

4. A method as defined in claim 3 including the step of providing a line of perforations across said tab and between said cut and the top end of said top of each individual bag.

5. A method as defined in claim 4 including the step of providing a hang hole through the tab of each individual bag between said line of perforations and the top end of said tab.

6. A method as defined in claim 5 including the steps of stacking said individual bags and bonding said tabs of said individual bags together.

7. A method as defined in claim 1 including the step of providing a gusseting box, and intermittently cutting said one of said opposing sides of said continuous wall while said continuous tube passes through said gusseting box.

8. A method as defined in claim 7 including the steps of providing a rotatable blade holder and a blade secured to said rotatable blade holder, and intermittently rotating said blade through said gusset box, thereby imtermittently cutting said one of said opposing sides of said continuous wall of said continuous tube.

9. A method as defined in claim 1 wherein said step of cutting said one of said opposing sides of said continuous wall includes slicing said one of said opposing sides with a cutting blade.

* * * * *